US005575745A

United States Patent [19]

Lin

[11] Patent Number: 5,575,745

[45] Date of Patent: Nov. 19, 1996

[54] SELF-ROTATIONAL EXERCISER

[76] Inventor: Tzu C. Lin, Fl. 11-5, No. 50, Sec. 4, Roosevelt Road, Taipei, Taiwan

[21] Appl. No.: 517,552

[22] Filed: Aug. 21, 1995

[51] Int. Cl.[6] ..... A63B 23/02

[52] U.S. Cl. ..... 482/144; 482/145

[58] Field of Search ..... 482/143, 144, 482/145

[56] References Cited

U.S. PATENT DOCUMENTS

| | | | |
|---|---|---|---|
| 3,286,708 | 11/1966 | Gartner | 482/144 |
| 3,519,268 | 7/1970 | McQueen | 482/144 |
| 4,113,250 | 9/1978 | Davis | 482/144 |
| 4,410,176 | 10/1983 | Miller | 482/144 |
| 4,494,533 | 1/1985 | Sgroi et al. | 482/144 |
| 4,502,682 | 3/1985 | Miller | 482/144 |
| 4,531,731 | 7/1985 | Law | 482/144 |
| 4,534,554 | 8/1985 | Miller | 482/144 |
| 4,534,555 | 8/1985 | Miller | 482/144 |
| 4,546,972 | 10/1985 | Goyer | 482/144 |
| 4,717,148 | 1/1988 | Brewer | 482/144 |
| 5,044,358 | 9/1991 | Morin | 482/144 |

*Primary Examiner*—Lynne A. Reichard

*Attorney, Agent, or Firm*—Beveridge, DeGrandi, Weilacher & Young, L.L.P.

[57] ABSTRACT

Disclosed is a self-rotational exerciser including a fixed stand and a rotational frame freely rotatably connected to the fixed stand via two pivots. The rotational frame includes two elongated side posts, a seat lever connected to lower ends of the side posts, and a foot confining device downward extending from the seat lever for confining a user's feet thereto. A handle lever is connected between upper portions of the side posts for the user to grip. A stand-up position of the user on the rotational frame gives the rotational frame a center of gravity higher than the two pivots and therefore allows the rotational frame to rotate whenever the user tilts his/her body forward or backward. A sitting position or other positions of the user on the rotational frame that give the latter a center of gravity lower than the two pivots shall allow the rotational frame to stay in still either in a normal postion, an upside-down position, or an angularly inclined position. Without any help from an outcoming force, the rotational frame of the exerciser can be freely rotated or kept in still in any direction at different rotational speed just by the user's different body positions and movements of different parts of the body.

8 Claims, 16 Drawing Sheets

SELF-ROTATIONAL EXERCISER

BACKGROUND OF THE INVENTION

1. Field of the Invention

The present invention relates to an exerciser, and more particularly to a rotational exerciser which is operable by a user and freely rotates together with the user so as to exercise the user's legs, waist, hands and head. In addition, by means of the rotatary movement, the exerciser serves to stimulate the user's cerebellum, enhance the user's balancing ability, and speed the user's blood circulation. The exerciser of the present invention is exciting and interesting.

2. Description of the Prior Art

There are different kinds of exercisers being widely used indoors, such as a multi-functional exerciser, a running exerciser, a treading exerciser, etc. These exercisers are designed to train different areas of a user's body.

However, the conventional exercisers are mostly used to train and strengthen the user's heart, lung, or muscle. The user usually operates the exerciser in a standing, lying or sitting position and therefore, only a certain area instead of the whole body is trained or exercised.

There is an "upside-down" exerciser developed with an intention to solve the above problems. The exerciser includes a back for a user to lie thereon, a step for confining the user's feet, and fastener means for connecting a control lever with an adjusting lever so as to bind the user's legs in place. When the user stretches his/her two hands backward, the back of the exerciser is pushed to incline backward and finally gets the user into an upside-down position. However, this exerciser only permits the users to be in an upside-down position and does not provide any overall exercising effect.

SUMMARY OF THE INVENTION

It is therefore a primary object of the present invention to provide a self-rotational exerciser which provides an overall exercising effect to a user, including stimulating the user's brain, enhancing the blood circulation and the stomach and the intestines, strengthening the heart, the lungs, the muscles, and the joints. The exerciser of the present invention may be used in free manner to either train all parts of the user's body at one time or selectively train some parts of the user's body.

The user can easily and safely operate the self-rotational exerciser of the present invention to exercise the whole body while enjoying an exciting and interesting feeling.

The self-rotational exerciser of the present invention is simple in structure and light in weight. The user may use the exerciser in different positions, including sitting, standing, lying on back, lying on abdomen, and declining head backward, straightened, or bowed. The change in position permits the exerciser to rotate at different speeds. The exerciser may also be held in place with the user being hung upside-down or at different inclining angles relative to the ground.

To achieve the above object, the self-rotational exerciser of the present invention includes a fixed stand and a rotational frame. When using the exerciser, the user firmly holds a handle portion attached to the rotational frame while his or her feet are securely supported by a foot confining device also attached to the rotational frame. Any change in the body position or any movement of the body will change the center of gravity of the rotational frame relative to a pivot connecting the fixed stand and the rotational frame, causing the rotational frame and the user to freely and continuously rotate.

In addition, an outer ring member can be pivotally connected at two points to the two pivots and associated with the rotational frame while a self-rotary frame is rotatably connected at two ends to the outer ring member, such that when the user biases his or her body's center of gravity relative to the outer ring member, the self-rotary frame is caused to rotate automatically.

Furthermore, an inclined wheel structure can be attached to the bottom of the present invention, making the whole self-rotational exerciser angularly bias from the vertical center line. The user may also drive the self-rotational exerciser to rotate about the shaft of the inclined wheel structure in a second direction by changing his/her own body position.

BRIEF DESCRIPTION OF THE DRAWINGS

The present invention can be best understood through the following detailed description of the preferred embodiment and the accompanying drawings, wherein:

FIGS. 9A and 9B are fragmentary and enlarged side views showing the operation of a latch device for holding the rotational frame to the fixed stand, wherein FIG. 9A shows a U-shaped latch holding the rotational frame to the fixed stand and FIG. 9B shows the U-shaped latch loosened to release the rotational frame from the fixed stand;

DETAILED DESCRIPTION OF THE PREFERRED EMBODIMENT

Figure 1:
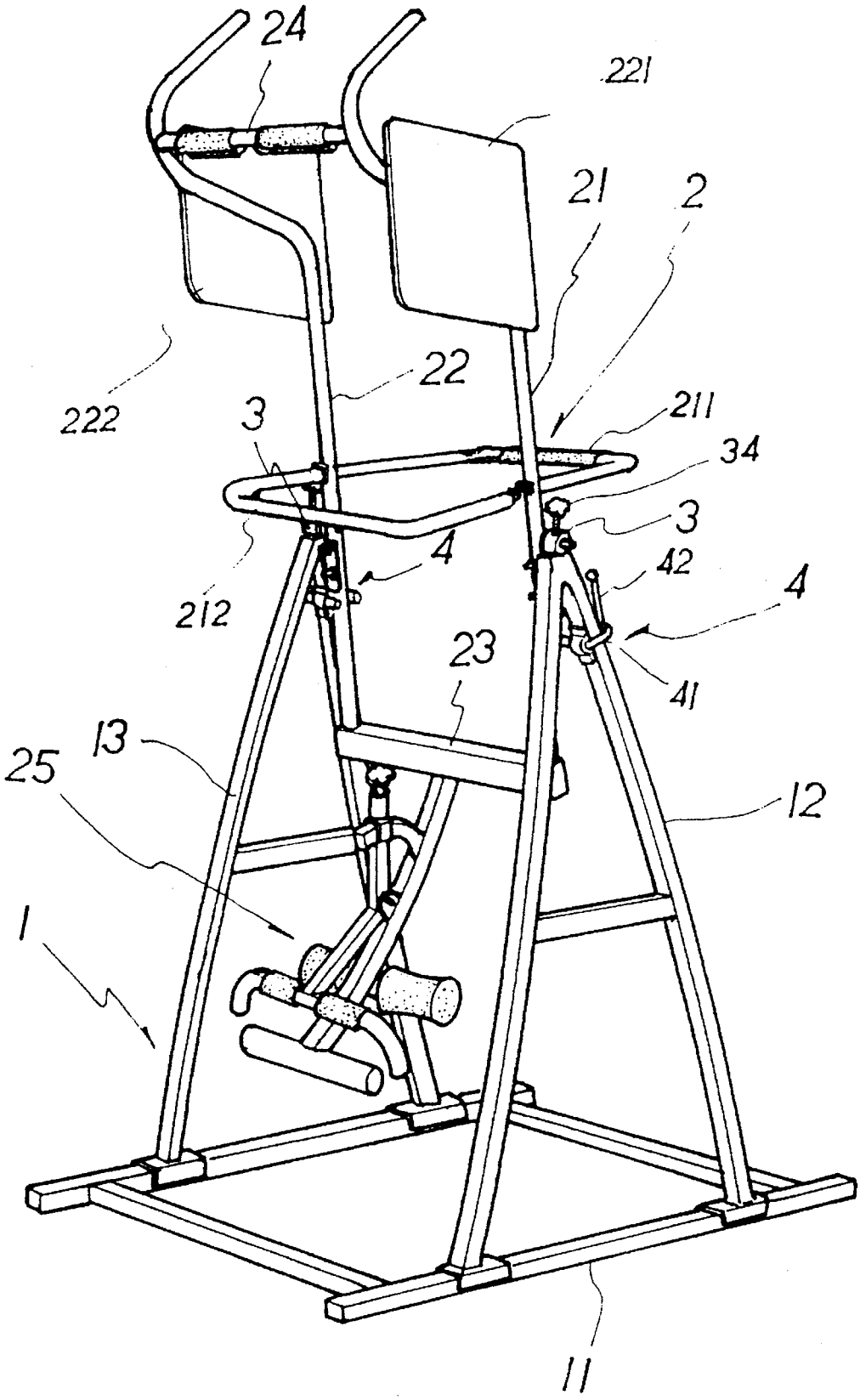
FIG. 1 is a perspective view of a preferred embodiment of the present invention.

Please refer to FIG. 1. The self-rotational exerciser of the present invention mainly includes a fixed stand 1 and a rotational frame 2 pivotally connected the fixed stand 1.

The fixed stand 1 includes a base 11 and two oppositely disposed A-shaped side supports 12, 13 extending upward from the base 11. The side supports 12, 13 gradually become closer to each other while they extend upward. That is, the distance between the side supports 12, 13 is gradually reduced from bottom to top. This reduction in distance between side supports 12, 13 is helpful in maintaining a more stable exerciser structure so as to prevent the same from tilting over when it is in use. The A-shaped side supports 12, 13 are respectively provided at a top end with a pivot 3 and the rotational frame 2 is rotatably connected thereto.

The rotational frame 2 includes two elongated side posts 21, 22 and a seat lever 23 transversing between and connected to two lower ends of the side posts 21, 22. Upper ends of each of the side posts 21, 22 are formed with a forward curved portion having a handle lever 24 transversing between and connected thereto. The two side posts 21, 22 are pivotally connected at their middle sections near the seat lever 23 to the side supports 12, 13 by means of the pivots 3, so that the rotational frame 2 is allowed to freely rotate forward or backward, relative to the fixed stand 1L.

Rear and front U-shaped protective frames 211, 212 are horizontally extended between and connected to the side posts 21, 22 somewhat above the pivots 3 for protecting the user. One end of the front protective frame 212 is separable from one of the side posts 21, 22.

A foot confining device 25 extends downward from a middle point of the seat lever 23 for securely confining the user's feet thereto without the risk of sliding therefrom.

Two protective side boards 221, 222 are attached to the side posts 21, 22 somewhat lower than the handle lever 24 for preventing the user's elbows from sidewardly extending out and being injured by the side posts 12, 13 during operating the rotational frame 2.

Figure 9B:
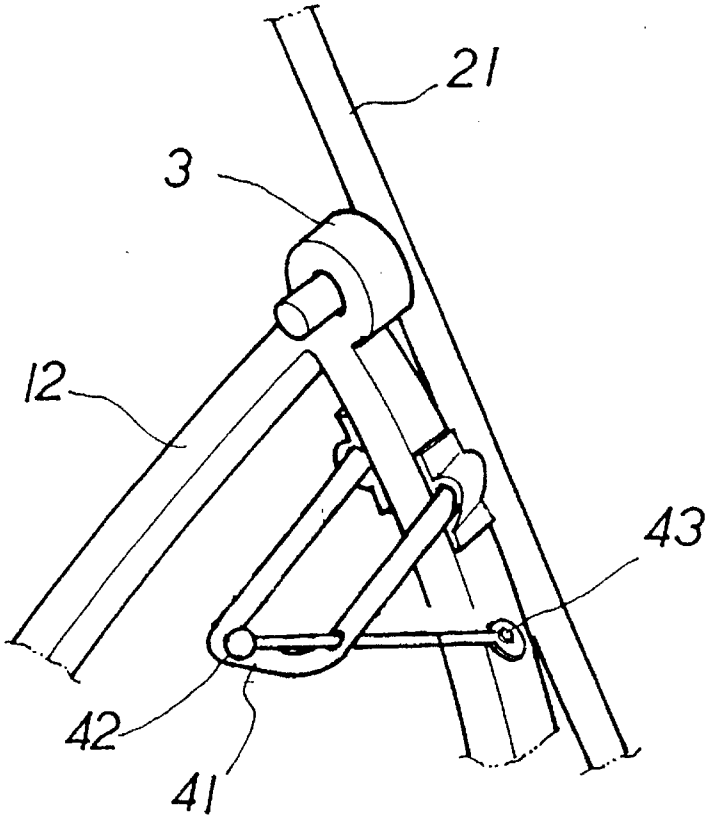
Figure 9A:
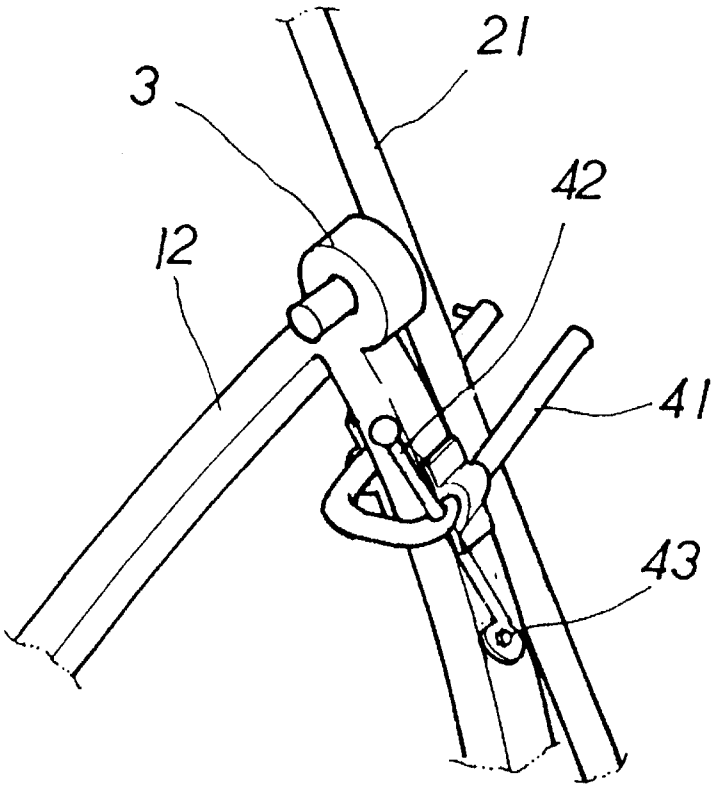

Two latch devices 4 are disposed on the side posts 12, 13 near and below the pivots 3 for holding the rotational frame 2 to the fixed stand 1 to prevent further rotation. As shown in FIG. 9A, each latch device 4 has a U-shaped latch member 41 long enough to extend the side support 12 or 13 to retain the side post 21 or 22 of the rotational frame 2 thereto and prevent the same from moving. A grip rod 42 is pivotally connected at one end to the side post 12 or 13 at a point 43 lower than the U-shaped latch member 41, such that a free end of the grip rod 42 extends through a hole on the U-shaped latch member 42. The pivotal movement of the grip rod 42 about the point 43 in a different direction may push the U-shaped latch member 41 forward to retain the side post 21 or 22 and hold the same to the side support 12 or 13 as shown in FIG. 9A or pull the U-shaped latch member 41 backward to release the side post 21 or 22 from the side support 12 or 13 as shown in FIG. 9B.

Figure 2:
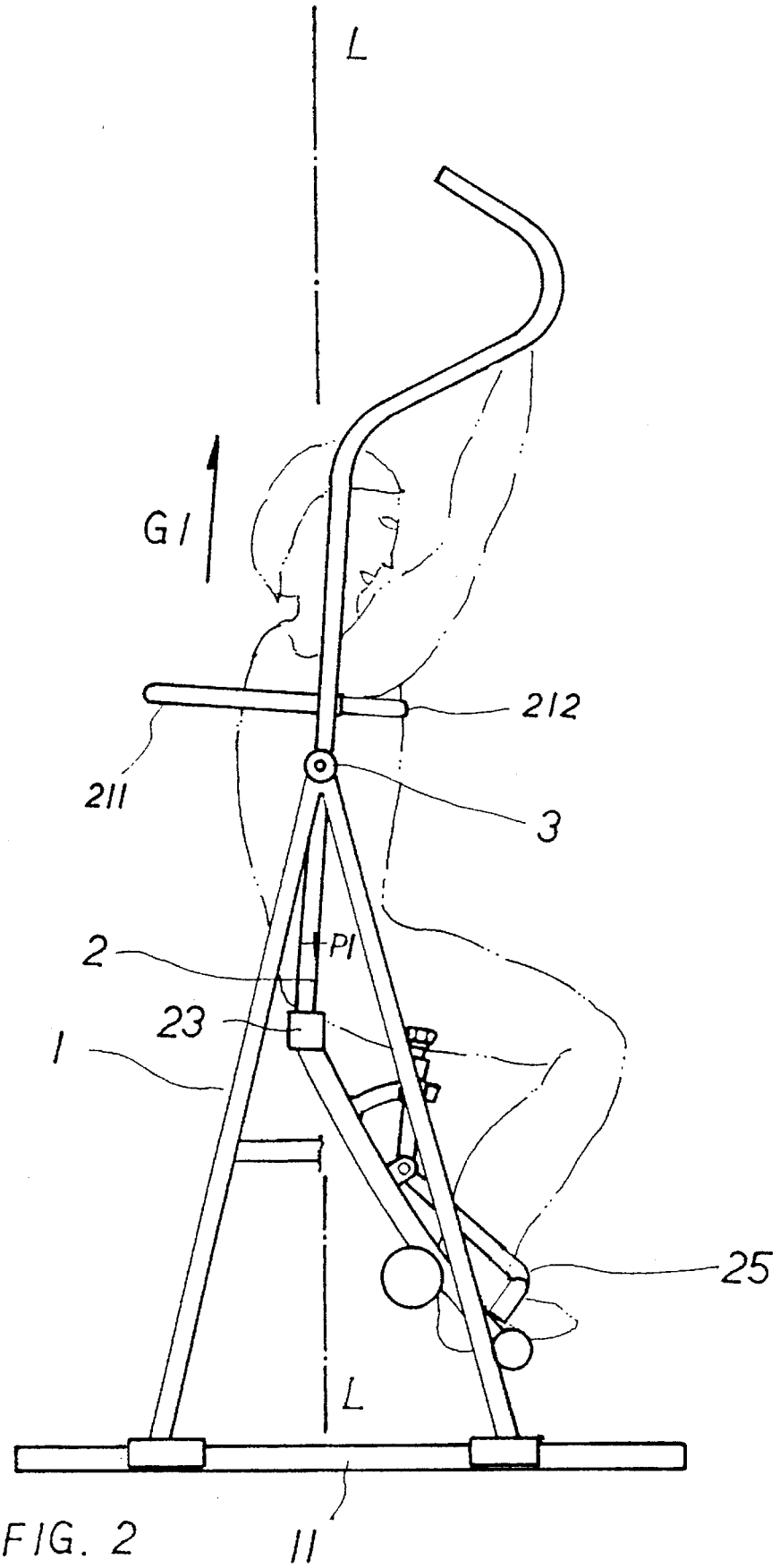
FIG. 2 is a side view according to FIG. 1, showing that a user is sitting on the rotational frame and facing forward.

Please now refer to FIGS. 2 to 5 in which the protective side boards 221, 222 and the latch devices 4 are removed for a clear illustration of the operation of the present invention. As shown in FIG. 2, the user's feet are confined by the foot confining device 25 and the user holds the handle lever 24 with the user's hip resting on the seat lever 23. At this time, the rotational frame 2 has a center of gravity P1 lower than the pivots 3 and on a vertical line L passing through the pivot 3 when viewing sidewardly. Thus, no rotational movement will take place. When the user stands up on the rotational frame 2 with his/her hip locating above the pivots 3, the rotational frame 2 shall have a center of gravity moved upward to a point P2 higher than the pivots 3 but still on the vertical line L, when viewing sidewardly. At this point, the rotational frame 2 does not rotate, either, as shown in FIG. 2A.

Figure 2A:
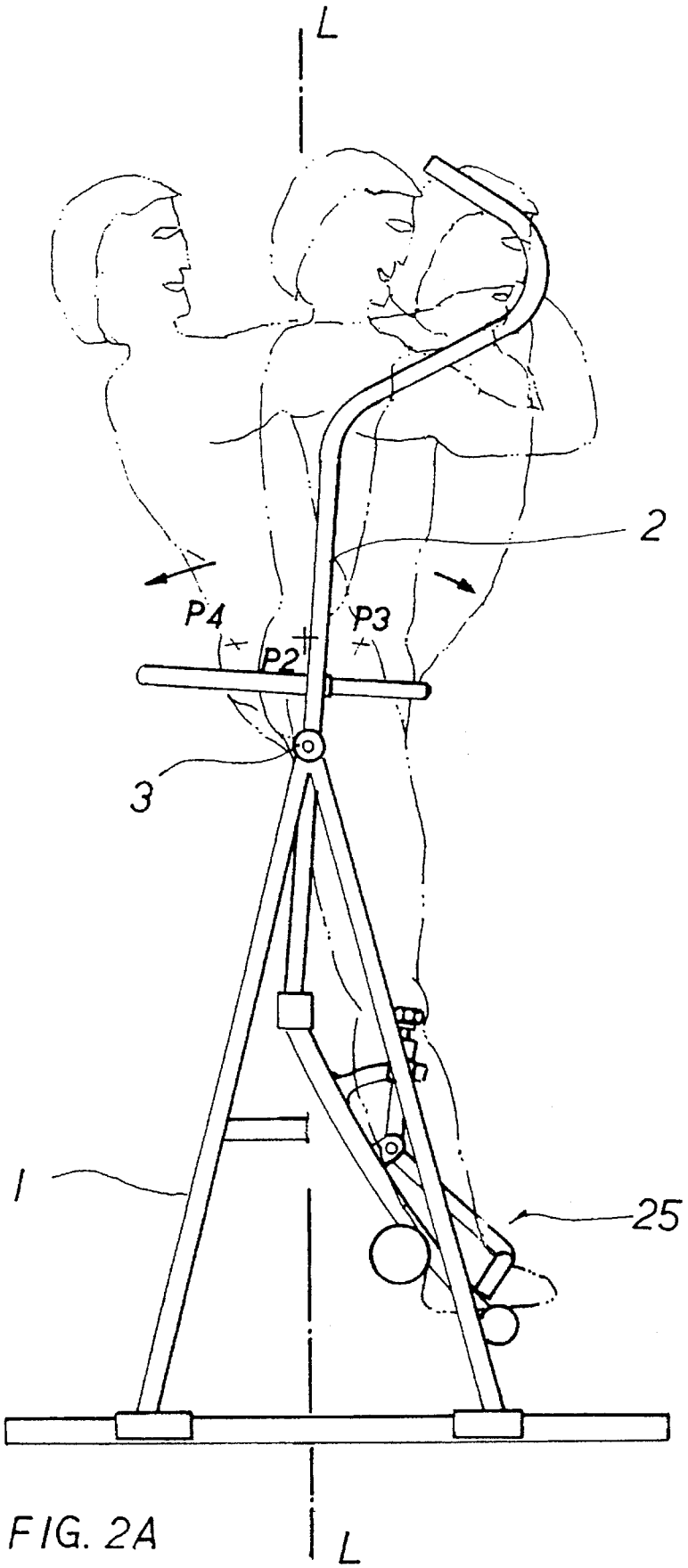
FIG. 2A is a side view similar to FIG. 2, wherein the user is standing on the rotational frame.

However, when the user stands on the rotational frame 2 with some parts of his/her body, such as his/her arms, waist or head exerting a forward or backward force, the center of gravity of the rotational frame 2 changes again to a point P3 in front of the vertical line L or a point P4 behind the vertical line L, respectively, as shown in FIG. 2A, causing the rotational frame 2 to rotate.

Figure 3:
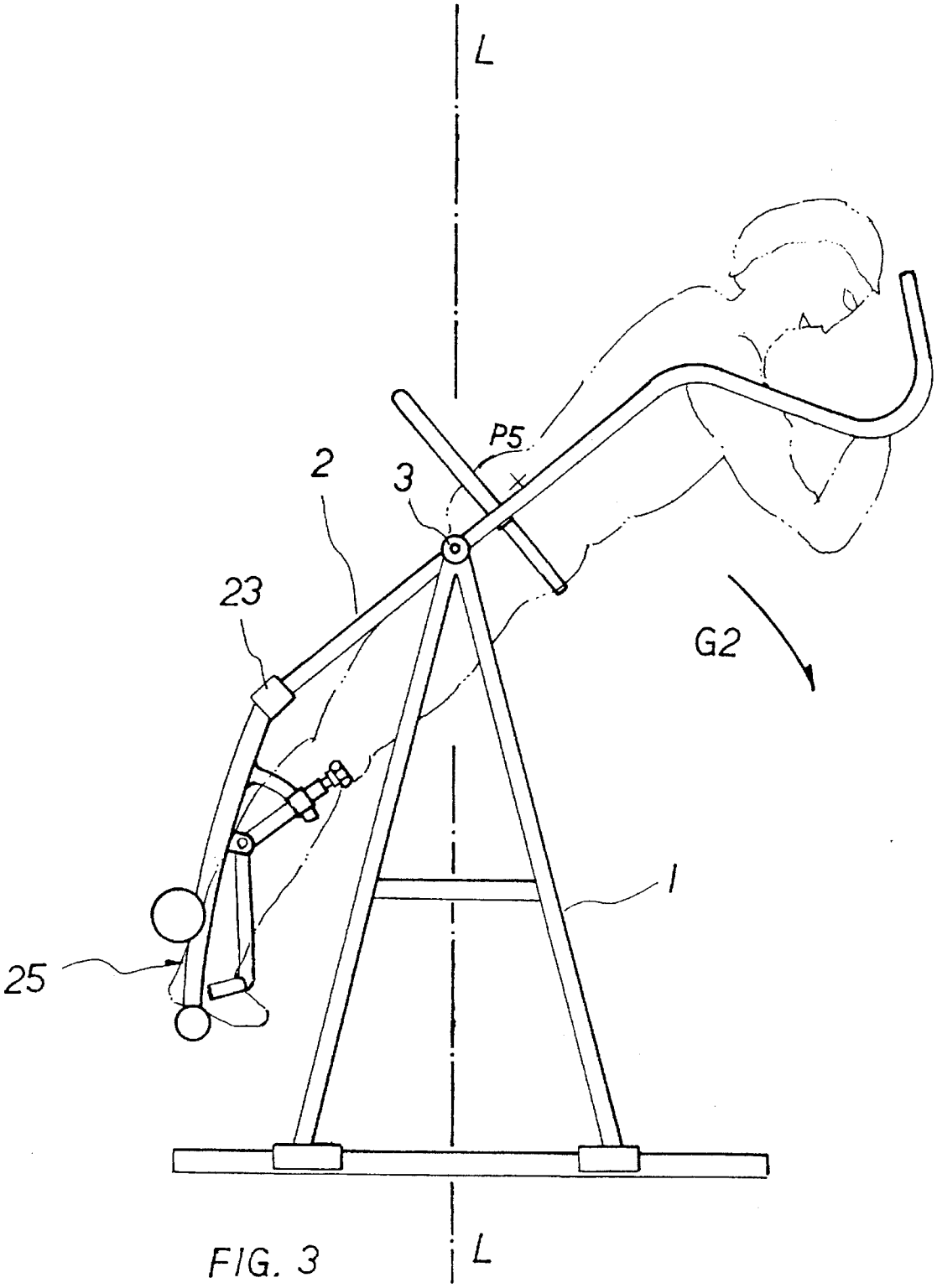
FIG. 3 is a side view according to FIG. 2, showing the user standing on the rotational frame, giving the rotational frame a center of gravity higher than the pivot connecting the fixed stand and the rotational frame and therefore causing the rotational frame to rotate downward.

In FIG. 3, the user tilts forward along with the rotating rotational frame 2 and the center of gravity of the rotational frame 2 is further biased from the vertical line L to a point P5. At this time, under the gravity force, the rotational frame 2 rotates downward in a direction as shown by the arrow G2 in FIG. 3.

Figure 4:
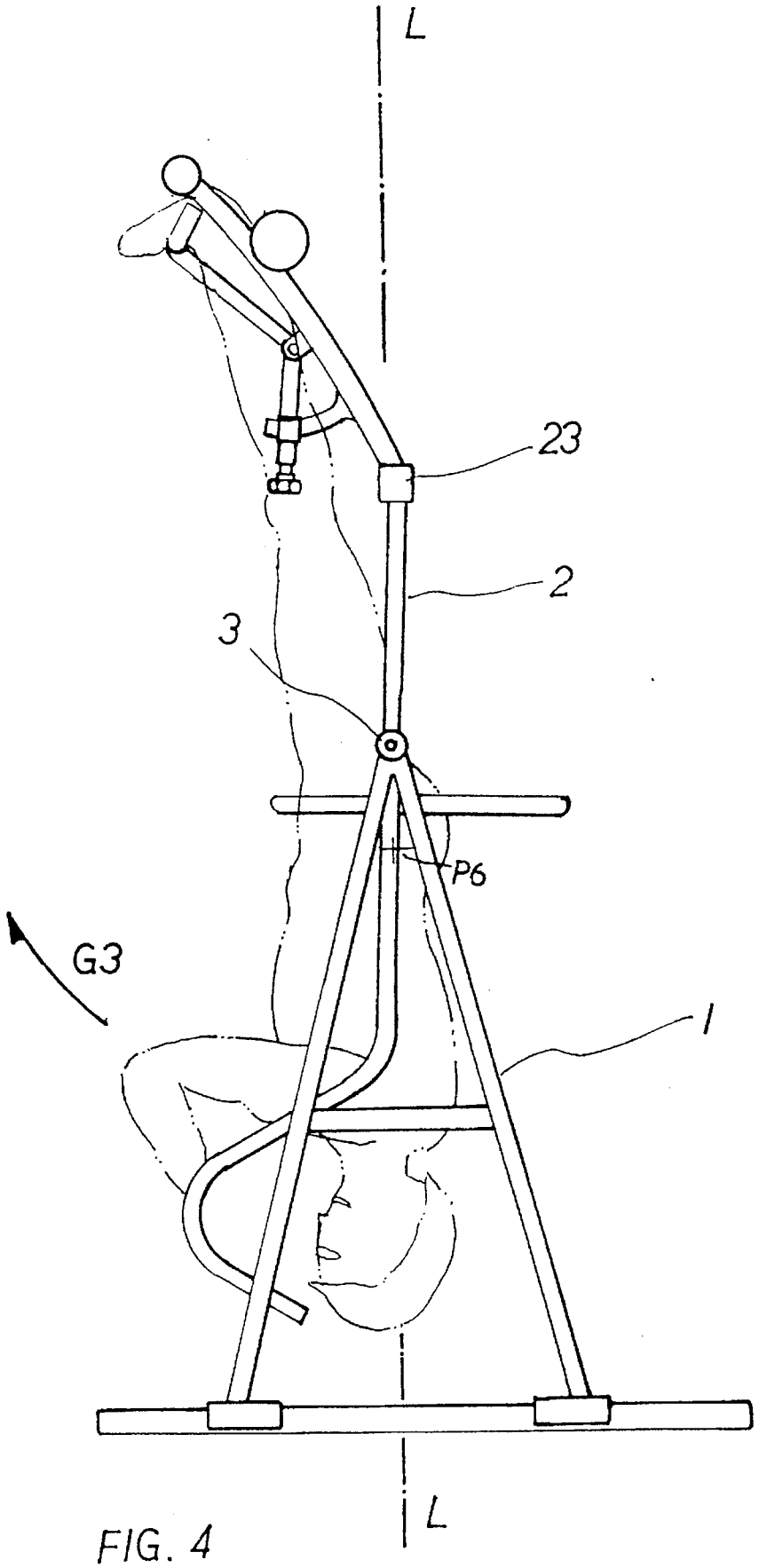
FIG. 4 is a side view showing the rotational frame with the user standing thereon rotated to a completely upside-down position.

When the rotational frame 2 with the user standing thereon rotates to a completely upside-down position as shown in FIG. 4 and the user fully stretches his/her body within the rotational frame 2, the center of gravity of the rotational frame 2 changes to a point P6 right under the pivots 3 on the vertical line L, when viewing sidewardly. At this time, the rotational frame 2 will keep still at the completely upside-down position if the user does not move his/her body.

Figure 4A:
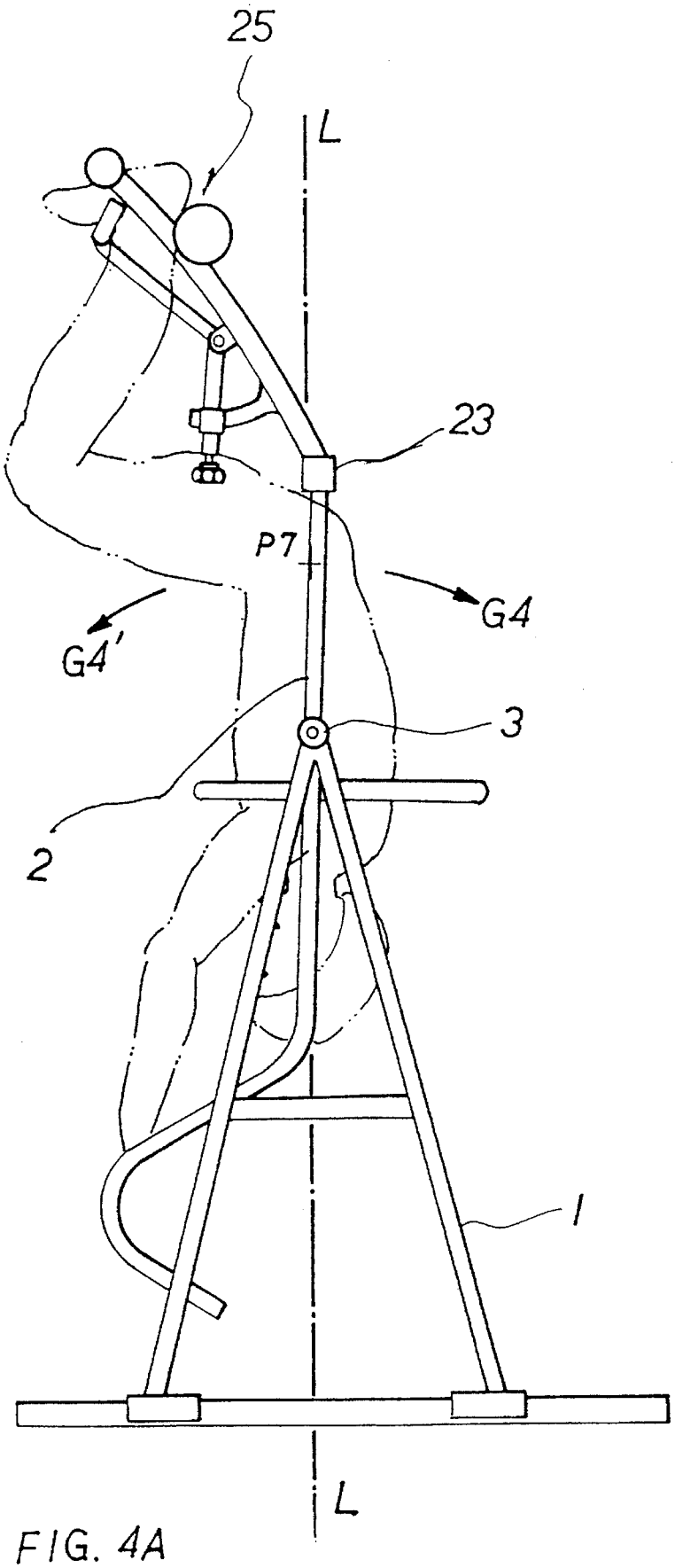
FIG. 4A is a side view similar to FIG. 4, wherein the user moves his hip toward a seat lever on the rotational frame.

Referring to FIG. 4A. When the user exerts force from his/her legs and waist to move his/her hip toward the seat lever 23, the center of gravity of the rotational frame 2 shifts to a point P7 higher than the pivots 3. At this point, any movement of the user's body shall cause the center of gravity of the rotational frame 2 to bias from the vertical line L and cause the rotational frame 2 to rotate in a direction as shown by the arrow G4 or G4'.

Due to an inertia of the rotating rotational frame 2, the user can easily control the rotational frame 2 to rotate continuously.

Figure 5:
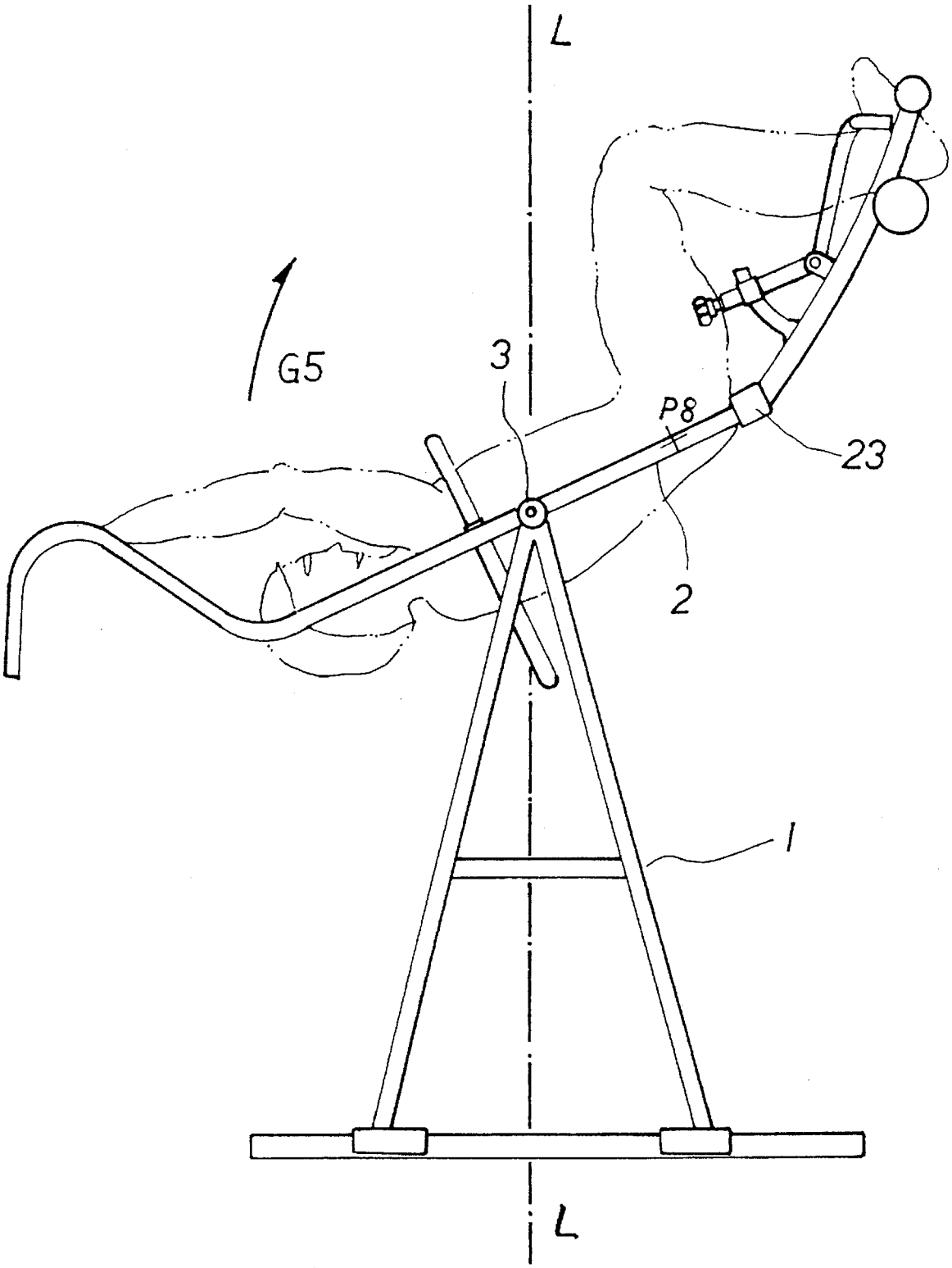
FIG. 5 is a side view showing that the user is sitting on the rotational frame, giving the rotational frame a center of gravity higher than the pivot connecting the rotational frame with the fixed stand and therefore causing the rotational frame to rotate upward.
Figure 5A:
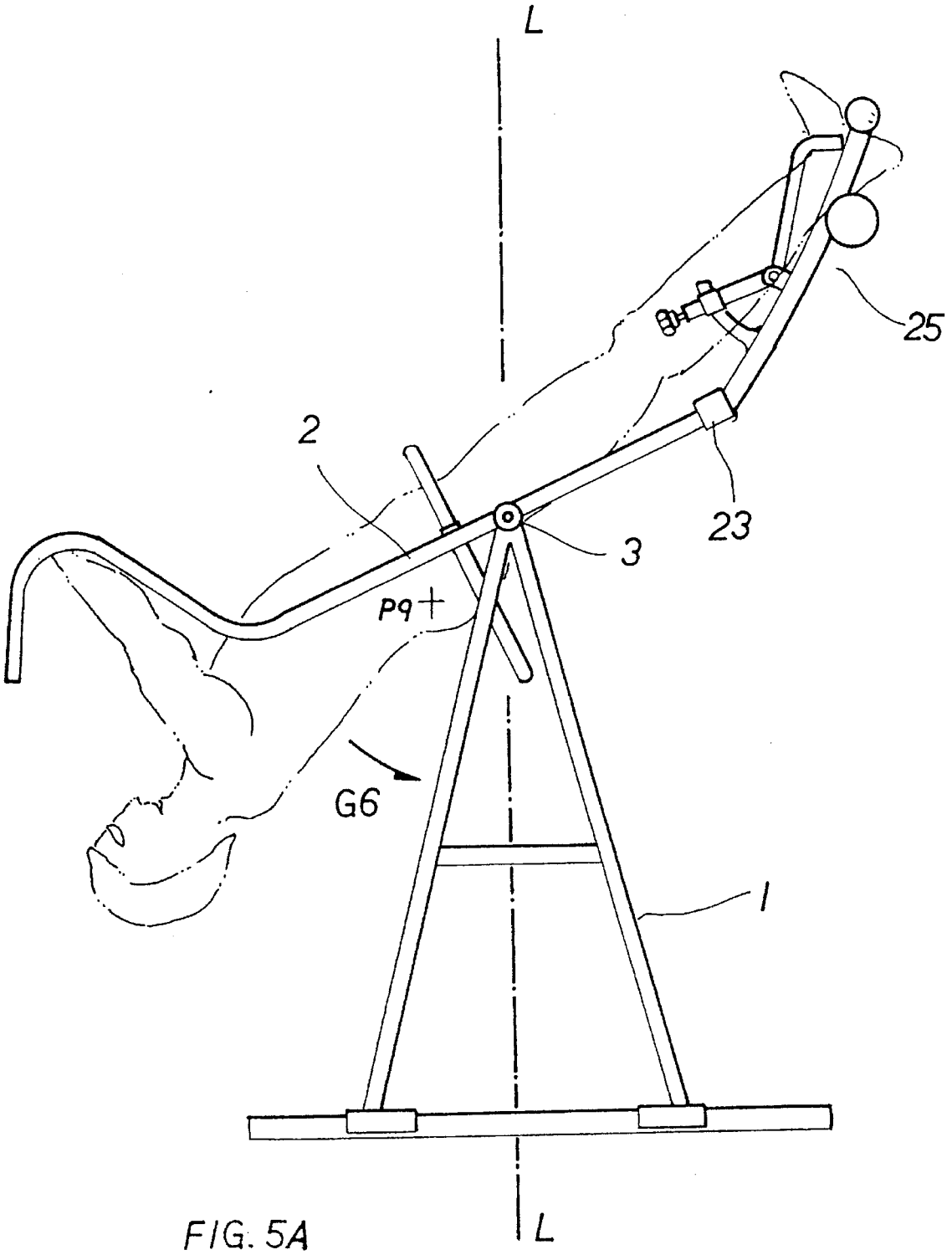
FIG. 5A is a side view similar to FIG. 5, wherein the user is standing on the rotational frame with two arms stretched forward to push his body away from the handle portion, giving the rotational frame a center of gravity lower than the pivot connecting the rotational frame with the fixed stand and therefore causing the rotational frame to rotate in a reverse direction.

When the rotational frame 2 rotates to a position as shown in FIG. 5, the center of gravity of the rotational frame 2 is shifted to a point P8 which is higher than the pivots 3 and further biases from the vertical line L. At this time, the rotational frame 2 keeps rotating in a direction as shown by the arrow G5 and returns to its home position as shown in FIG. 2 to complete a circle of rotation. However, in the event the rotational frame 2 rotates to the position as shown in FIG. 5 with the user in a fully stretched position as shown in FIG. 5A, the rotational frame 2 shall have a center of gravity at a point P9 lower than the pivots 3. At this time, the rotational frame 2 will rotate in a reverse direction as shown by the arrow G6 in FIG. 5A.

Of course, the user may repeat the same movement to keep the rotational frame 2 rotating in the same direction. Or, the user may reverse the rotation direction of the rotational frame 2 by changing his/her body movement.

Moreover, the user can control the rotational speed of the rotational frame 2 by moving his/her body differently. For example, the user may further tilt his/her body forward or backward to cause the center of gravity of the rotational frame 2 to further bias from the vertical line L. By this way, the rotational frame 2 will rotate at a faster speed. Otherwise, the rotational frame 2 will rotate at a slower speed.

In addition, the user may cause the rotational frame 2 to stay still at any time during the rotation of the rotational frame 2 by positioning the center of gravity of the rotational frame 2 at any point on the vertical line L.

Except the user's hands and feet which are respectively fixed on the handle lever 24 and the foot confining device 25, the other parts of the user's body can freely move to adjust the position of the center of gravity to control the rotary movement of the rotational frame 2.

When it is desired to stop the rotational frame 2 from further rotating after several times of rotatary movements, the user may simply sit down on the seat lever 23 and keep the other parts of his/her body still. As a result, the rotational frame 2 will safely return to its home position without any outcoming force.

Moreover, when the rotational frame 2 is rotated to the upside-down position as shown in FIG. 4, the U-shaped latch members 41 can be used to lock the side posts 21, 22 of the rotational frame 2 in place. At this time, the user can push himself/herself upward to train his/her muscle in an upside-down position.

Figure 6:
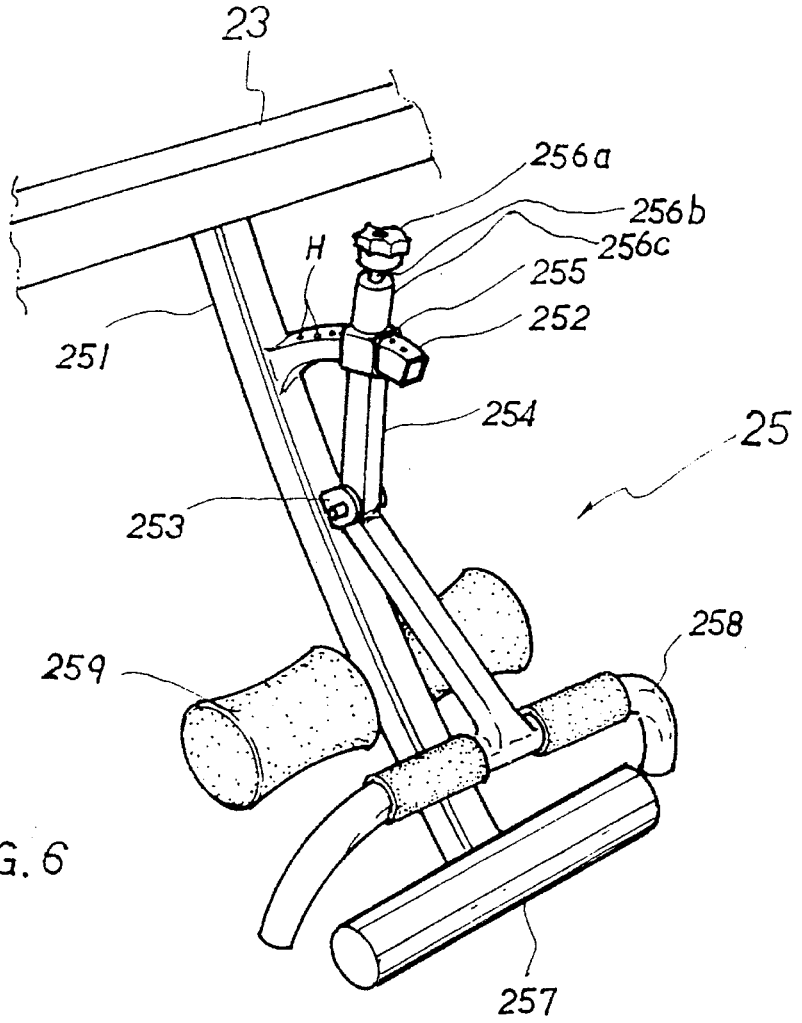
FIG. 6 is a fragmentary and enlarged perspective view showing the foot confining device attached to the rotational frame.

Please now refer to FIG. 6 which shows the foot confining device 25 of the present invention. The foot confining device 25 includes: a central stem 251 extending downward from a middle section of the seat lever 23; a transverse beam 257 connected to a bottom end of the central stem 251; an arched lever 252 extending forward from an upper section of the central stem 251 and formed with a plurality of locking holes H thereon; a pair of lugs 253 disposed on the central stem 251 below the arched lever 252; a pair of leg stopper levers 259 horizontally disposed on two sides of the central stem 251 above the transverse beam 257; an elbow-like lever 254 having a bent middle section pivotally connected at an angled point to. and between the two lugs 253 with two arm portions separately extending inclinedly upward and downward; and a sliding section 255 disposed at an upper end of the upward extended arm portion of the elbow-like lever 254, such that the sliding section 255 is slidably fitted around the arched lever 252. A substantially U-shaped lever 258 is connected to a lower end of the downward extended arm portion of the elbow-like lever 254 to cooperate with the transverse beam 257 to securely confine the user's feet to the rotational frame 2.

Figure 7A:
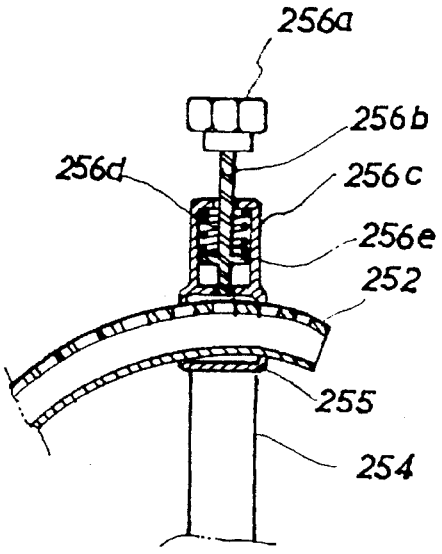
FIG. 7A is a fragmentary and enlarged sectional view similar to FIG. 7, wherein a locking pin of the locking means is pulled upward, permitting a slide member thereof to slide along an arch lever.
Figure 7:
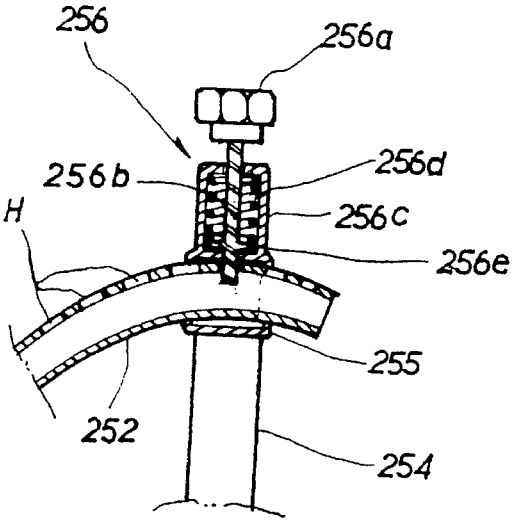
FIG. 7 is a fragmentary and enlarged sectional view showing the locking means for the foot confining device.
Figure 8B:
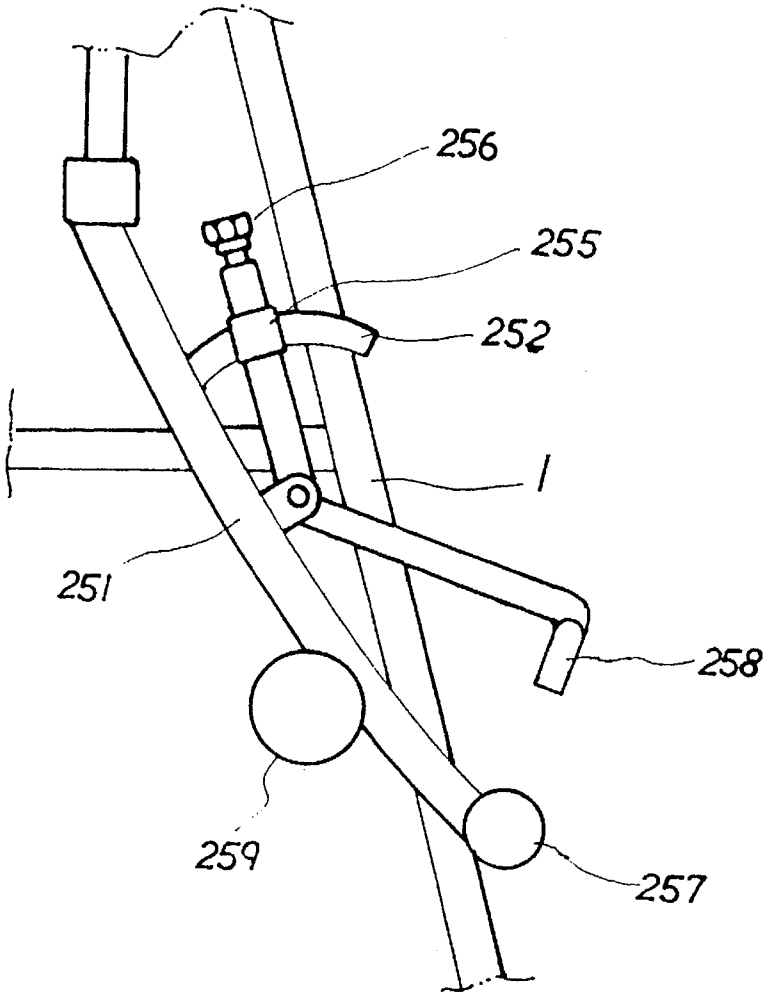
FIGS. 8A and 8B are fragmentary and enlarged side views showing the adjustment of the foot confining device.
Figure 8A:
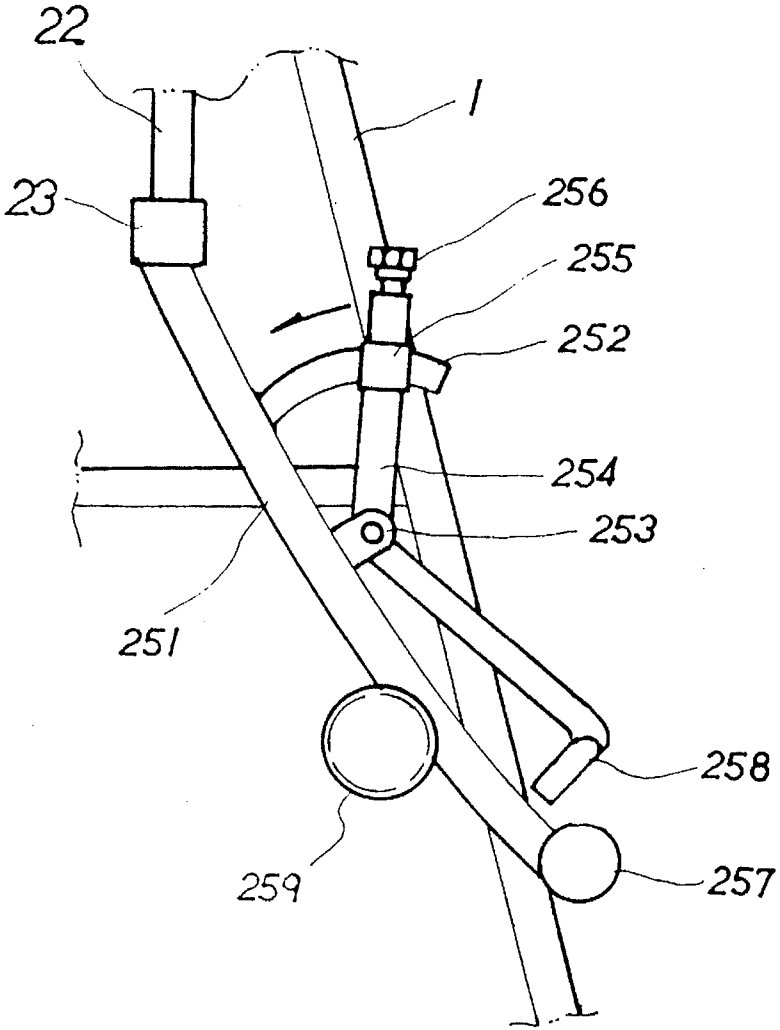

Please refer to FIGS. 6, 7 and 7A. A locking means 256 is disposed on the sliding section 255 and includes a pull knob 256*a* and a locking pin 256*b* extending downward from the pull knob 256*a* into a cylindrical sleeve body 256*c* directly above the sliding section 255. The locking pin 256*b* has a pressing disk 256*e* and a lower end which extends through a top wall of the sliding section 255 and into one of the locking holes H of the arched lever 252. A compression spring 256*d* is disposed in the sleeve body 256*c* around the locking pin 256*b* with a lower end thereof abutting against the pressing disk 256*e* of the locking pin 256*b* so as to keep the locking pin 256*b* in a normally depressed position. Referring to FIG. 7A, when the pull knob 256*a* is pulled upward, the locking pin 256*b* is drawn upward with its lower end moving out of the locking hole H of the arched lever 252. At this time, the sliding section 255 is permitted to slide along the arched lever 252. Accordingly, the elbow-like lever 254 can be pivotally shifted about the lugs 253 to adjust the distance between the U-shaped lever 258 and the transverse beam 257. As shown in FIGS. 8A and 8B, the U-shaped lever 258 serves to press against the user's insteps while the leg stopper levers 259 serve to support the user's calves with the user's soles rested on the transverse beam 257, so that the user's feet can be securely confined by the foot confining device 25. By means of selectively inserting the locking pin 256*b* into the respective locking holes H of the arched lever 252, the distance between the U-shaped lever 258 and the transverse beam 257 can be adjusted and fixed to suit different users. The above foot confining device is only a preferred embodiment of the present invention. Any other equivalent means should also fall within the scope of the present invention.

When using the present invention, the user may first sit on the seat lever 23 and then lock the front protective frame 212 to the side post 21. Then, the user may position his/her feet on the foot confining device 25 to be securely confined thereto. Thereafter, by means of different positions and movements of different parts of the body, the user is able to rotate the rotational frame 2 safely. During the rotary movement, the user may even release the handle lever 24 without causing any danger. During the rotatary movement of the rotational frame 2, the user is permitted to sit, stand, lie on back, or lie on abdomen while on the exerciser with his/her head inclined backward, chest straightened, or body bowed so as to change the rotational speed of the rotational frame 2. Moreover, the exerciser with the user thereon can also be controlled to stay still in an upside-down position or at any inclined angles.

During the rotatary movement, a centrifugal force will stimulate the user's cerebellum to extend its balancing ability, and enhance the blood circulation and the function of the heart, the lung, the stomach, and the intestines of the user. Also, when the user changes his/her positions to control the rotatary movement, both the user's muscles and joints are strengthened. Therefore, the self-rotational exerciser of the present exerciser can get every part of the user's body exercised.

Figure 10:
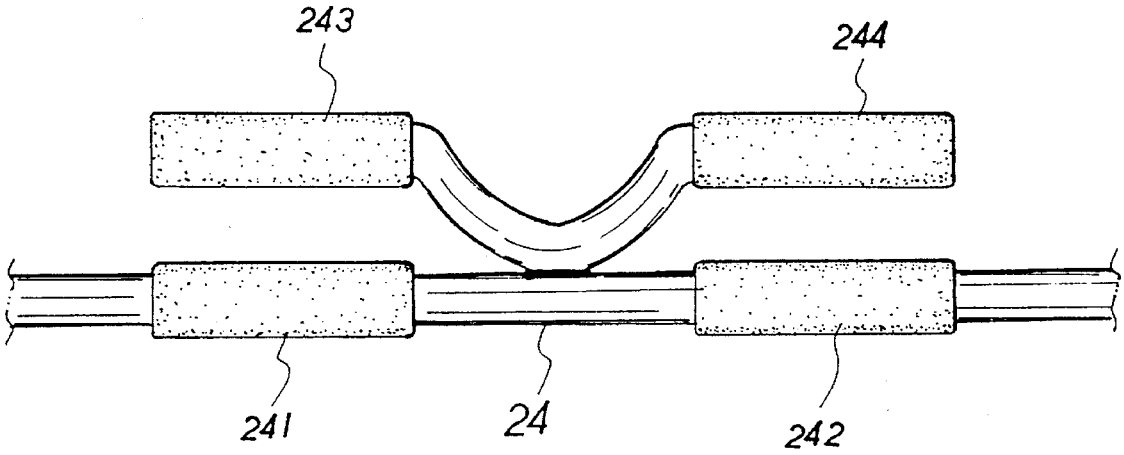
FIG. 10 is a fragmentary, enlarged, plan view showing an embodiment of the handle lever of the present invention.

Furthermore, to safely guard the user's hands from accidently loosening from the hand lever 24, a stopping handle having two stoppers 243, 244 is connected to the hand lever 24 to correspond to two grip portions 241, 242 on the hand lever 24, as shown in FIG. 10. A clearance is left between the stoppers 243,244 and the grip portions 241, 242 and is just large enough for the user to extend his or her palms therethrough so as to firmly hold the grip portions 241, 242 with fingers and having the backs of his or her hands pressing against the stoppers 243, 244. The grip portions 241, 242 together with the stoppers 243,244 exert a clamping force on the user's hands and effectively prevent the user from injury due to any accidental release of his or her hands from the hand lever during operation of the self-rotational exerciser.

Figure 11:
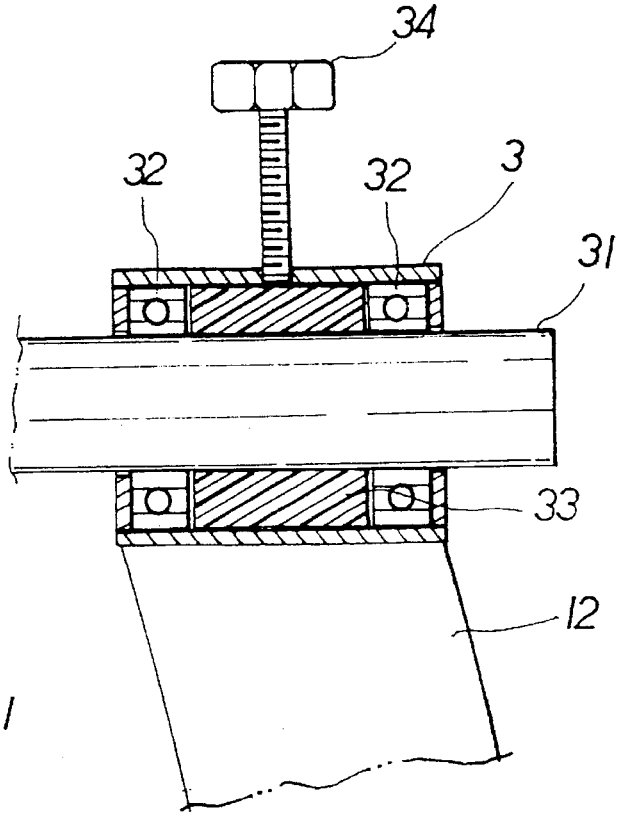
FIG. 11 is a fragmentary, enlarged, sectional view showing the pivot of the present invention.

And, to meet the needs of different users, the pivots 3 may be provided with an adjusting means. Please refer to FIG. 11, the pivot 3 each has a shaft 31 rotatably supported on bearings 32. A rubber bushing 33 is further provided around the shaft 31. An adjusting screw 34 is tightly screwed from outside of the pivot 3 toward the rubber bushing 33. When the adjusting screw 34 is threaded inward to tightly press against the bushing 34, the shaft 31 is subjected to a larger resistance during rotating and would need a larger torque to complete the rotation. On the other hand, when the adjusting screw 34 is turned to move outward from the bushing 33, the shaft 31 needs a smaller torque to rotate. For those who dare not to rotate the self-rotational exerciser at high speed, the adjusting screw 34 can be threaded inward to press against the bushing 33 tighter, and thereby causes the exerciser to rotate at a slower speed.

Figure 12:
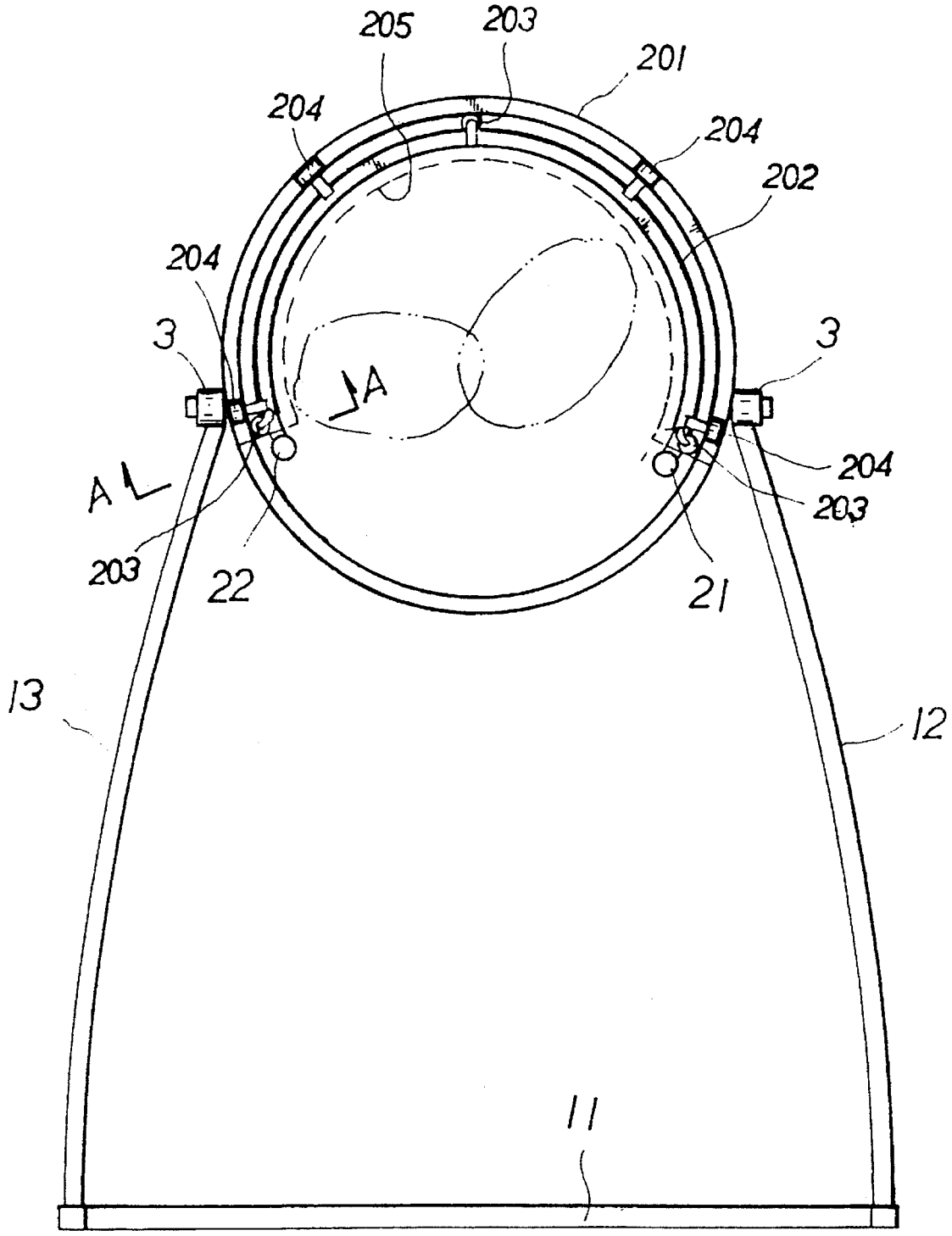
FIG. 12 illustrates another variation of the self-rotational exerciser of the present invention.
Figure 13:
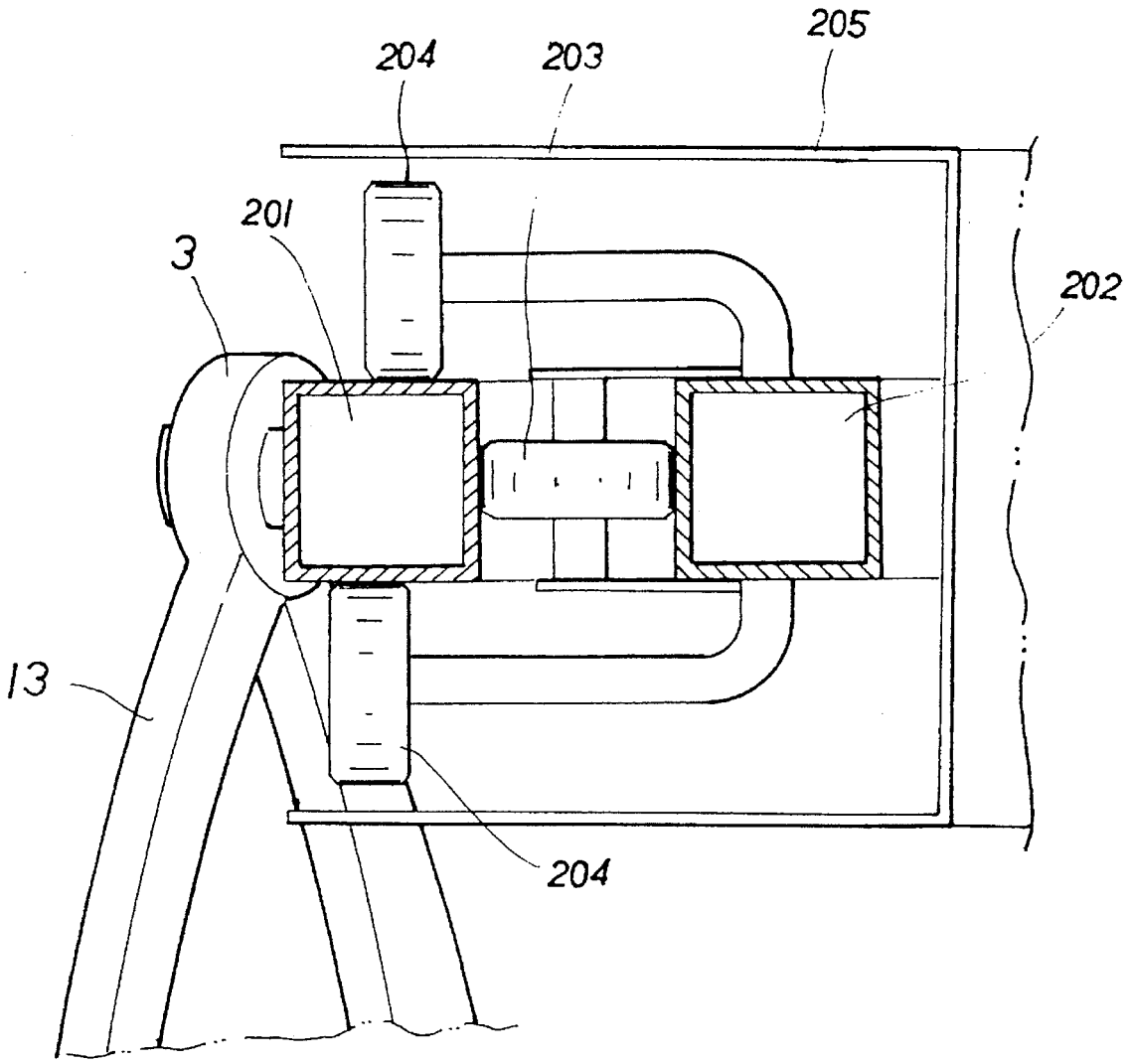
FIG. 13 is a fragmentary, enlarged, sectional plan view taken on line AA of FIG. 12.

Please refer to FIG. 12 in which a variation of the present invention is shown. For the purpose of clarity, the rotational frame 2 shown in FIG. 12 has been turned to a horizontal position relative to the side supports 12, 13. The rotational frame 2 has an outer ring member 201 which is rotatably connected at two points thereof to the pivots 3 so as to be associated with the A-shaped side supports 12, 13. Please further refer to FIG. 13, a curved self-rotary frame 202 is connected to an inner circumference of the outer ring member 201 by means of a plurality of horizontal pulleys 03 and vertical guide roller assemblies 204, such that the curved self-rotary frame 202 is permitted to freely slide along the inner circumference of the outer ring member 201. For the purpose of safety, a protective housing 205 is used to enclose the length of the outer ring member 201 within which the guide rollers 204 and the pulleys 203 are mounted, lest the user should be clamped and injured by these components. Two ends of the self-rotary frame 202 are connected to the side posts 21, 22 of the rotational frame 2. Means for safely fixing the user's hands and feet in place are also provided on an upper and a lower portion of the side posts 21, 22.

By these arrangements, when the user changes his or her position within the curved self-rotary frame 202 and causes the center of gravity of the user's body to shift relative to the exerciser, the self-rotary frame 202 shall automatically rotate relative to the outer ring member 201 under the effect of gravity.

Since the outer ring member 201 is connected to the side supports 12, 13 via the pivots 3, the user may still drive the whole rotational frame 2 to rotate about the pivots 3 by moving his or her body into different positions in the rotational frame 2. When the user properly moves his or her body in the curved self-rotary frame 202 while the frame 2 is rotating relative to the side supports 12, 13, the curved self-rotary frame 202 shall rotate at the same time to provide more fun to the user.

Figure 14:
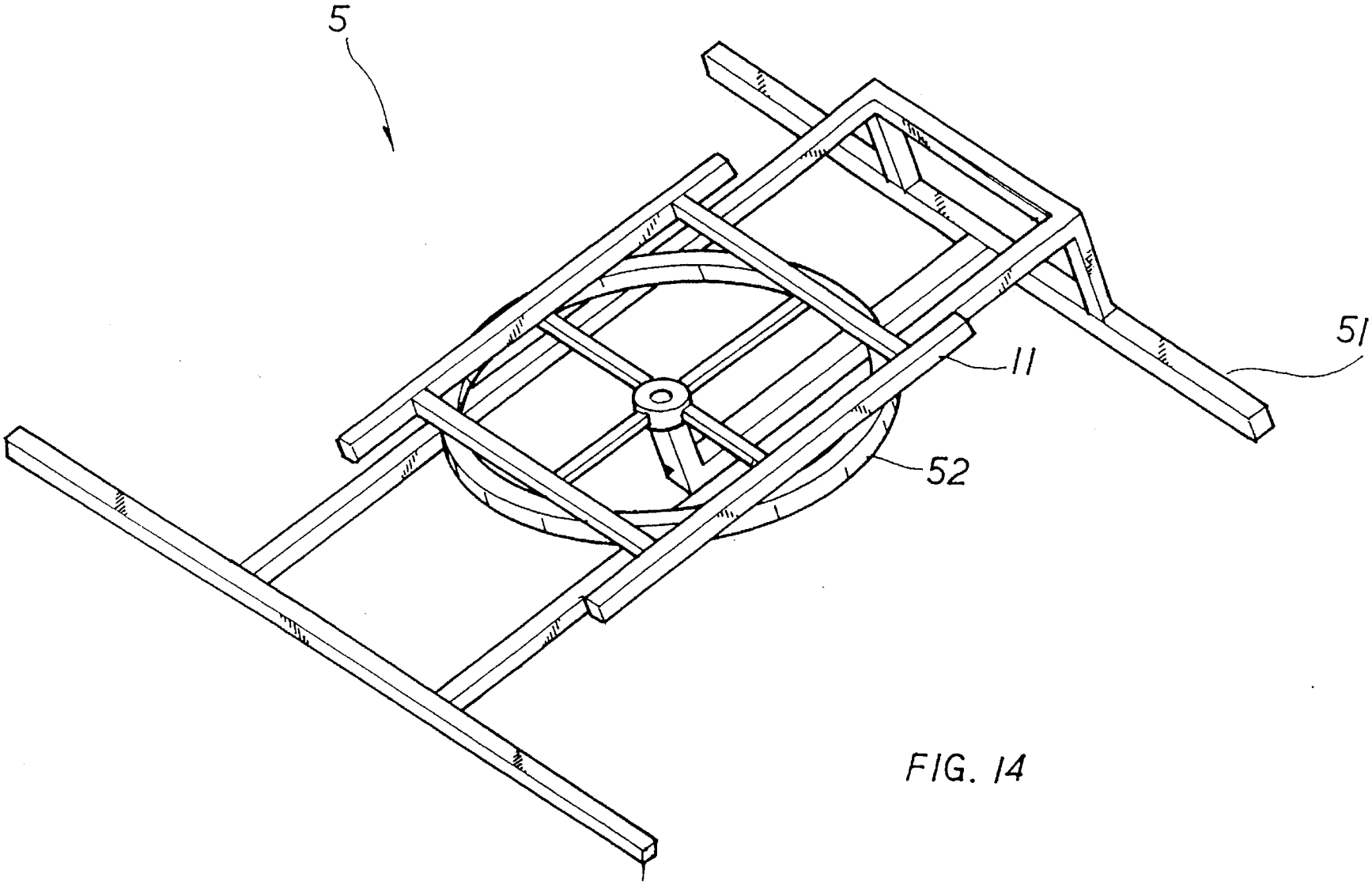
FIG. 14 shows that the base of the present invention is mounted onto an inclined wheel structure.
Figure 15:
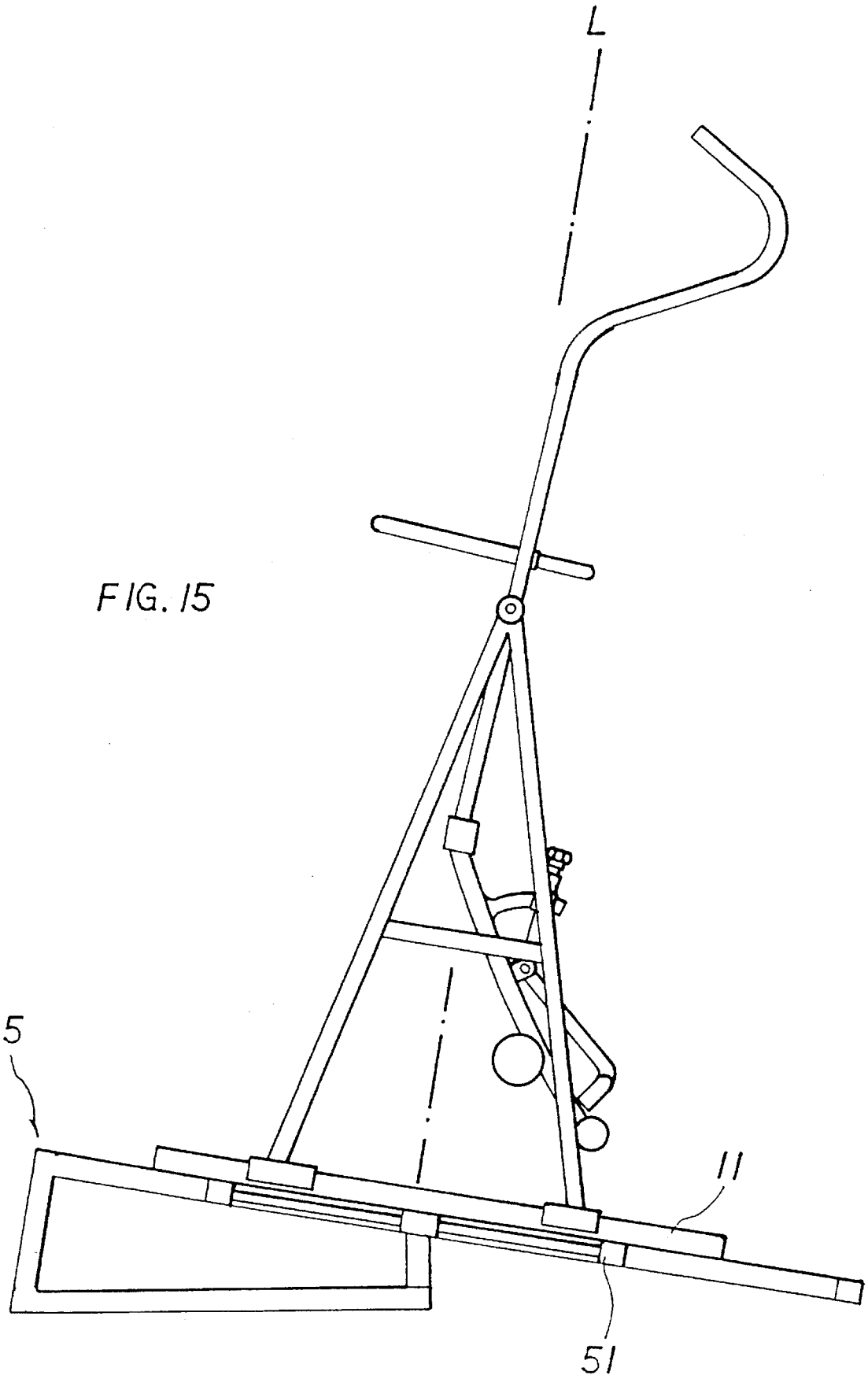
FIG. 15 is an elevational side view showing the present invention mounted onto the inclined wheel structure.

FIG. 14 illustrates still another variation of the present invention in which the base 11 of the present invention is mounted onto an inclined wheel structure 5. The wheel structure 5 has an inclined frame 51 having one end lower than the other end, and a wheel 52 rotatably mounted on the inclined frame 51. The base 11 is fixedly mounted on the wheel 52 and thereby causes the whole self-rotational exerciser to angularly bias from the initial vertical central axis, as shown in FIG. 15. When the user properly moves his or her body within the rotational frame 2 and causes the same to rotate relative to the side supports 12, 13, the exerciser fixed on the wheel 52 shall turn along the rotary wheel 52 about its own central axis.

Or, the inclined wheel structure shown in FIG. 14 can be combined with the outer ring member and curved self-rotary frame shown in FIG. 12 to create a three-dimensional rotational effect which is surely more exciting.

Many modifications of the above preferred embodiment can be made without departing from the spirit of the present invention. The scope of the present invention is only defined by the appended claims.

What is claimed is:

1. A self-rotational exerciser, comprising:

a fixed stand including a base having two lateral sides.

at least two side supports extending upward from said lateral sides of said base, and two pivots respectively disposed on said side supports; and a rotational frame being rotatably connected to said fixed stand via said two pivots, said rotational frame including two elongated side posts, a seat lever connected transversely between said two elongated side post, a foot confining device extending downwardly from said seat lever, a hand lever connected transversely between said two elongated side posts, and a stopping handle connected to said hand lever, said stopping handle positioned behind said hand lever such that a clearance is formed for insertion of a user's palm, wherein said rotational frame is able to freely rotate relative to said fixed stand in either a clockwise or counterclockwise direction about said two pivots or remain fixed depending on a user's body position and movements.

2. A self-rotational exerciser, comprising:

a fixed stand including a base having two lateral sides, at least two side supports extending upward from said lateral sides of said base, and two pivots respectively disposed on said side supports; and a rotational frame being rotatably connected to said fixed stand via said two pivots, said rotational frame including two elongated side posts having upper portions, at least one of said upper portions of said side posts having a forward curved portion, a seat lever connected transversely between said two elongated side posts, a foot confining device extending downwardly from said seat lever, and a hand lever connected transversely between said two elongated side posts at said curved portion, wherein said rotational frame is able to freely rotate relative to said fixed stand in either a clockwise or counterclockwise direction about said two pivots or remain fixed depending on a user's body position and movements.

3. A self-rotational exerciser comprising:

a fixed stand including a base having two lateral sides, at least two side supports extending upward from said lateral sides of said base, two pivots respectively disposed on said side supports, an a latch device disposed on each of said at least two side supports; and rotational frame being rotatably connected to said fixed stand via said two pivots, said rotational frame including two elongated side posts, a seat lever connected transversely between said two elongated side posts, a foot confining device extending downwardly from said seat lever, and a hand lever connected transversely between said two elongated side posts, wherein said latch device includes a U-shaped latch member for extending through at least one of said side supports to retain at least one of said two elongated side posts whereby said rotational frame is prevented from rotating, and a grip rod pivotally connected at one end to a pivot point on said at least one of said side supports and angularly extending a free end through said U-shaped latch member, said U-shaped latch member being pushed forward or pulled backward to lock or release, respectively, said at least one of said two elongated side posts to or from said at least one of said side supports of said fixed stand via pivotal movement of said grip rod, and wherein said rotational frame is able to freely rotate relative to said fixed stand in either a clockwise or counterclockwise direction about said two pivots or remain fixed depending on a user's body position and movements.

4. A self-rotational exerciser, comprising:

a fixed stand including a base having two lateral sides, at least two side supports extending upward from said lateral sides of said base, and two pivots respectively disposed on said side supports; and a rotational frame being rotatably connected to said fixed stand via said two pivots, said rotational frame including two elongated side posts, a seat lever connected transversely between said two elongated side posts, a foot confining device extending downwardly from said seat lever, a hand lever connected transversely between said two elongated side posts, and two protective side boards separately disposed on at least one of said two side posts somewhat lower than said handle lever for preventing a user from extending an elbow out sideward when said rotational frame is rotating, wherein said rotational frame is able to freely rotate relative to said fixed stand in either a clockwise or counterclockwise direction about said two pivots or remain fixed depending on a user's body position and movements.

5. A self-rotational exerciser, comprising:

a fixed stand including a base having two lateral sides, at least two side supports extending upward from said lateral sides of said base, and two pivots respectively disposed on said side supports; and rotational frame being rotatably connected to said fixed stand via said two pivots, said rotational frame including two elongated side posts, a seat lever connected transversely between said two elongated side posts, a foot confining device extending downwardly from said seat lever, said foot confining device including a central stem extending downward from a middle section of said seat lever, a transverse beam connected with a bottom end of said central stem, an arched lever extending forward from an upper section of said central stem and formed with a plurality of locking holes thereon, a pair of leg stopper levers horizontally disposed on two sides of said central stem above said transverse beam, an elbow-like lever having a bent middle section pivotally connected at an angled point to said central stem below said arched lever and a sliding section connected to an upper end of said elbow like lever and fitted around said arched lever, a locking means disposed on said sliding section for adjusting position of said elbow-like lever relative to said transverse beam, and a substantially U-shaped lever connected to a lower end of said elbow-like lever to cooperate with said transverse beam in confining a user's feet in place, and a hand lever being connected transversely between said two elongated side posts, wherein said rotational frame is able to freely rotate relative to said fixed stand in either a clockwise or counterclockwise direction about said two pivots or remain fixed depending on a user's body position and movements.

6. A self-rotational exerciser as claimed in claim 5, wherein said locking means includes a pull knob, and a locking pin downward extending from said pull knob and into a cylindrical sleeve body disposed on said sliding section, said locking pin being provided at a lower portion with a pressing disk and having a lower end extending through a top wall of said sliding section and into one of said locking holes of said arched lever, and said cylindrical sleeve body having a compression spring disposed therein with a lower end of said spring pressing against said pressing disk of said locking pin so as to keep said locking pin in a normally depressed position to extend into one of said locking holes on said arched lever.

7. A self-rotational exerciser, comprising:

a fixed stand including a base having two lateral sides, at least two side supports extending upward from said lateral sides of said base, and two pivots respectively disposed on said side supports; and a rotational frame being rotatably connected to said fixed stand via said two pivots, said rotational frame including two elongated side posts, a seat lever connected transversely between said two elongated side posts, a foot confining device extending downwardly from said seat lever, a hand lever being connected transversely between said two elongated side posts, an outer ring member rotatably connected to said at least two side supports via said pivots so as to rotate about said pivots relative to said at least two side supports, and a curved self-rotary frame connected to an inner circumference of said outer ring member by means of a plurality of horizontal pulleys and vertical guide roller assemblies, said curved self-rotary frame being capable of automatically and freely sliding along said inner circumference of said outer ring member to rotate therein, and said curved self-rotary frame being connected at two ends with said hand lever and said foot confining device of said rotational frame, wherein said rotational frame is able to freely rotate relative to said fixed stand in either a clockwise or counterclockwise direction about said two pivots or remain fixed depending on a user's body position and movements.

8. A self-rotational exerciser as claimed in claim 1, wherein said base is fixedly mounted onto an inclinedly disposed wheel structure, said wheel structure comprising an inclined frame having one end lower than the other end thereof, and a wheel freely rotatably mounted on said inclined frame and fixedly supporting said base thereon.

* * * * *